US008360938B2

(12) United States Patent
Gilman

(10) Patent No.: US 8,360,938 B2
(45) **Date of Patent: *Jan. 29, 2013**

(54) HIP THRUST SLED

(75) Inventor: Neil F. Gilman, South Glastonbury, CT (US)

(73) Assignee: Marty Gilman, Inc., Gilman, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/076,659

(22) Filed: Mar. 31, 2011

(65) Prior Publication Data

US 2011/0177891 A1 Jul. 21, 2011

Related U.S. Application Data

(63) Continuation of application No. 12/622,866, filed on Nov. 20, 2009, now Pat. No. 7,955,223.

(51) Int. Cl.
*A63B 21/00* (2006.01)

(52) U.S. Cl. ..... 482/51; 482/93; 482/90; 482/97

(58) Field of Classification Search ..... 482/51, 482/90; 473/445, 441, 440
See application file for complete search history.

(56) References Cited

U.S. PATENT DOCUMENTS

| | | | | |
|---|---|---|---|---|
| D159,950 | S * | 9/1950 | Brown | D12/8 |
| 3,355,186 | A | 11/1967 | Earl | |
| 3,380,084 | A | 4/1968 | Savage | |
| 4,453,742 | A | 6/1984 | Zepkowski | |
| 4,890,495 | A | 1/1990 | Slane | |
| 5,385,523 | A | 1/1995 | Forrest | |
| 5,397,154 | A | 3/1995 | Baldwin | |
| D377,507 | S | 1/1997 | Thomas | |
| D382,515 | S * | 8/1997 | Love | D12/9 |
| D390,500 | S | 2/1998 | Walker | |
| D466,963 | S | 12/2002 | Forrest | |
| D469,142 | S | 1/2003 | Forrest | |
| D478,954 | S | 8/2003 | Forrest | |
| 6,612,971 | B1 | 9/2003 | Morris | |
| 6,685,581 | B2 | 2/2004 | Krause et al. | |
| 6,942,585 | B1 | 9/2005 | Krause | |
| 7,322,893 | B2 | 1/2008 | Bright | |
| D562,417 | S | 2/2008 | Noojin | |
| D606,611 | S * | 12/2009 | Rogers et al. | D21/788 |
| 7,727,089 | B2 * | 6/2010 | Gilman | 473/445 |
| 7,837,209 | B2 * | 11/2010 | Spencer et al. | 280/87.042 |

OTHER PUBLICATIONS

"The Sprinter's Sled", Speed City International, Inc., Fall 2002 Catalog, p. 10.
"Power Sled", Power Systems Sports, 2007 Catalog, p. 15.
"Handle for Power Sled", Power Systems Sports, 2007 Catalog, p. 15.
"Sled Dawg", MF Athletic Catalog, 2007, p. 33.
"Sled of Champions", Perform Better Catalog, 2006 Sports Edition, p. 4.

* cited by examiner

*Primary Examiner* — Jerome W Donnelly
(74) *Attorney, Agent, or Firm* — Day Pitney LLP

(57) ABSTRACT

A hip thrust sled may include a pair of spaced apart runners configured in generally parallel relation to each other. A first cross member extends between and is connected to the spaced apart runners proximate to a distal end of the hip thrust sled. A second cross member extends between and is connected to the spaced apart runners near a proximal end of the hip thrust sled to receive removable weights. A pendulum arm is rotatably attached at its distal end to the first cross member and is configured at a proximal end to move vertically relative to the spaced apart runners. The pendulum arm extends towards the proximal end of the hip thrust sled at an upward angle. An adjustable stop may limit the vertical movement of the pendulum arm. A handlebar may be attached to the proximal end of the pendulum arm.

5 Claims, 3 Drawing Sheets

HIP THRUST SLED

RELATED APPLICATIONS

This application is a continuation of and claims priority to U.S. patent application Ser. No. 12/622,866, filed 20 Nov. 2009, the entire contents of which are incorporated herein by reference.

FIELD OF INVENTION

The present invention relates to sport training sleds and more specifically to a hip thrust sled.

BACKGROUND

Many contact sports, like football, require a player to block an opponent to prevent that opponent's forward movement. For example, in football, an offensive player may block a defensive player who is trying to break through the line of scrimmage and tackle the quarterback before the quarterback passes the ball. As another example, a defensive player may block offensive players on the line of scrimmage to give other defensive players the opportunity to break through the line of scrimmage and tackle the quarterback.

Training is a large part of any sport, and requires effective equipment to simulate real play conditions as close as possible. For contact sports such as football, weight sleds are often used to train athletes. Weight sleds are different from tackling or blocking sleds in that tackling and blocking sleds are typically used for explosive impact training in which a user hits the tackling or blocking sled. Weight sleds are meant to be driven forward to provide a user with resistance for strength training while promoting proper body positioning. Weight sleds often provide static handles or dummies that attach to the weigh sled close to the user. This results in a feeling not unlike pushing a heavy lawn mower, rather than throwing a block and driving an opponent backwards. Further, by placing the handle or dummy closer to the player and the weight (including added weight) further away, the far, distal end of the sled may act as a fulcrum and the sled becomes an effective lever, lessening the effective weight of sled if the user lifts the handle or dummy upward.

Further, during real play, an opponent is heavy and moves, often from a crouched position to a more vertical position, while pushing forward. This requires the blocker to also move upward and drive with his hips under him in a more upright position, rather than behind him in a flat back position. Also, for defensive training, a player may want to practice an explosive push to lock out an opponent in conjunction with a push away or arm over to break away from the block and get to a quarterback. This requires that the handle or dummy not be unusually tall, which may be a problem for shorter players using a non-adjustable weight sled.

Further, the dummies that are used on tackling or blocking sleds, and on some weight sleds, are not useful for practicing good hand positioning, and are generally not helpful for athletes other than football players. For example, basketball, baseball and volleyball players may benefit from using a weight sled, but would not benefit from having to drive the weights sled forward while holding a dummy.

Further still, typical weight sleds, or tackling or blocking sleds, do not provide for hip thrust training. In many sports, such as football, basketball and volleyball, the athlete typically must thrust his hips under his body to perform basic moves within the sport. Typical hip strengthening machines are stationary, and thus do not enable the athlete to drive a weight forward and/or upward while rolling his hips forward and under his body.

SUMMARY

The present invention provides a weight sled that enables a more realistic training for a wider range of athletes of varying heights, and provides a better workout for athletes of different sports.

In general, in one aspect, an implementation of the disclosure features a hip thrust sled comprising a pair of spaced apart runners configured in generally parallel relation to each other. A first cross member extends between and is connected to the spaced apart runners proximate to a distal end of the hip thrust sled. A second cross member extends between and is connected to the spaced apart runners near a proximal end of the hip thrust sled and is configured to receive removable weights. A pendulum arm is rotatably attached at a distal end to the first cross member and is configured at a proximal end to move vertically relative to the spaced apart runners. The pendulum arm extends towards the proximal end of the hip thrust sled at an upward angle relative to the spaced apart runners and an adjustable stop may be configured to limit the vertical movement of the pendulum arm in relation to the spaced apart runners. Finally, a handlebar may be attached to the proximal end of the pendulum arm.

In certain embodiments, the handlebar may be a generally U-shaped configuration. In other embodiments, the handlebar may include two grips extending downward from the pendulum arm. In still other embodiments, the handlebar may include two grips extending downward from a handlebar cross member attached to the proximal end of the pendulum arm. In various embodiments, handlebar extends downward from the proximal end of the pendulum arm and is angled relative to a vertical reference line.

In various embodiments, the second cross member may also include a horn extending therefrom on which weight plates may be removably attached.

In various embodiments, the first member may also include a stop support member to which the adjustable stop is connected. In certain embodiments, the stop support member may be a curvilinear member configured to straddle over the pendulum arm and configured to hold the adjustable stop over the pendulum arm.

In certain embodiments, the adjustable stop may include an outer member, a slide member configured to move within the outer member, and a locking member configured to retain the slide member in various positions within the outer member. In various embodiments, the outer member includes a hole through the outer member and the slide member includes a plurality of holes along a length of the slide member. The locking member is a quick release pin which passes through the hole in the outer member and engages one of the plurality of holes along the length of the slide member, which retains the slide member in a specific position within the outer member. In certain embodiments, the adjustable stop may also include a saddle movably attached to the slide member configured to engage the pendulum arm to limit the upward vertical movement of the pendulum arm.

In still other embodiments, the hip thrust sled may also include a distal end cross member extending between and connected to the spaced apart runners at the distal end of the hip thrust sled. In certain embodiments, the hip thrust sled may include at least one tow lug attached adjacent to the distal end cross member. In other embodiments, the hip thrust sled may also include at least one tow lug attached to at least one of the spaced apart runners.

In general, in another aspect, an implementation of the disclosure features a hip thrust sled including a pair of spaced apart runners configured in parallel relation to each other and a first cross member extending between and connected to the spaced apart runners proximate to a distal end of the hip thrust sled. A pendulum arm may be attached at its distal end to the cross member and extends towards a proximal end of the hip thrust sled at an upward angle relative to the spaced apart runners.

In various embodiments, the hip thrust sled may also include a second cross member extending between and connected to the spaced apart runners near a proximal end of the hip thrust sled, which is configured to receive removable weights.

In certain embodiments, the pendulum arm may be rotatably attached at its distal end to the first cross member and the proximal end of the pendulum arm is configured to move vertically relative to the spaced apart runners.

In various embodiments, the hip thrust sled may also include an adjustable stop configured to limit the vertical movement of the pendulum arm in relation to the spaced apart runners. In certain embodiments, the adjustable stop may include an outer member, a slide member configured to move within the outer member, and a locking member to retain the slide member in various positions.

In general, in still another aspect, an implementation of the disclosure features a hip thrust sled including a pair of spaced apart runners configured in generally parallel relation to each other. A distal end cross member extends between and is connected to the spaced apart runners at a distal end of the hip thrust sled. A first cross member extends between and is connected to the spaced apart runners proximate to the distal end of the hip thrust sled. A second cross member extends between and is connected to the spaced apart runners near a proximal end of the hip thrust sled and is configured to receive removable weights. A pendulum arm is rotatably attached at its distal end to the first cross member and extends towards the proximal end of the hip thrust sled at an upward angle relative to the spaced apart runners. A proximal end of the pendulum arm is configured to move vertically relative to the spaced apart runners and may include a handlebar. The handlebar may be angled relative to a vertical reference line and includes two grips configured to extend downward from the proximal end of the pendulum arm. A stop support member is attached to the first cross member and is configured to straddle over the pendulum arm. An adjustable stop is attached to the stop support member and is configured to limit the vertical movement of the pendulum arm in relation to the spaced apart runners. The adjustable stop may include an outer member, a slide member configured to move within the outer member, a locking member configured to retain the slide member in various positions within the outer member, and a saddle movably attached to the slide member. The saddle may be configured to engage the pendulum arm to limit the upward vertical movement of the pendulum arm.

One or more of the following features may be included.

The invention may be implemented to realize one or more of the following advantages. The hip thrust sled enables a user to drive forward (horizontally along the ground) while lifting the handlebars in an upward direction (vertically). The hip thrust sled promotes the flexing of the user's knees and the rolling of the user's hips as the hip thrust sled is driven forward while lifting the handlebars. The adjustable stop enables the pendulum arm to accommodate the height and strength of various users. The configuration of the handlebars may help promote "inside hands" or "tight hands," as well as enabling athletes of different sports to utilize the hip thrust sled for training. The configuration of the hip thrust sled requires the athlete to practice good technique to control the hip thrust sled and roll his hips under his body to thrust the hip thrust sled upwards. The attachment of the distal end the pendulum arm to towards the distal end of the hip thrust sled and the attachment of the removable weights near the proximal end of the hip thrust sled more effectively utilizes the true weight of the removable weights, and helps prevent the pendulum arm from acting like a lever providing mechanical advantage with relation to the removable weights. The tow lugs provide the versatility to enable the hip thrust sled to be pulled, for example, by attaching a shoulder, belt, arm or rope harness to the tow lugs.

Other features and advantages of the invention are apparent from the following description, and from the claims.

BRIEF DESCRIPTION OF THE DRAWINGS

Like reference numbers and designations in the various drawings indicate like elements.

DETAILED DESCRIPTION

Figure 1:
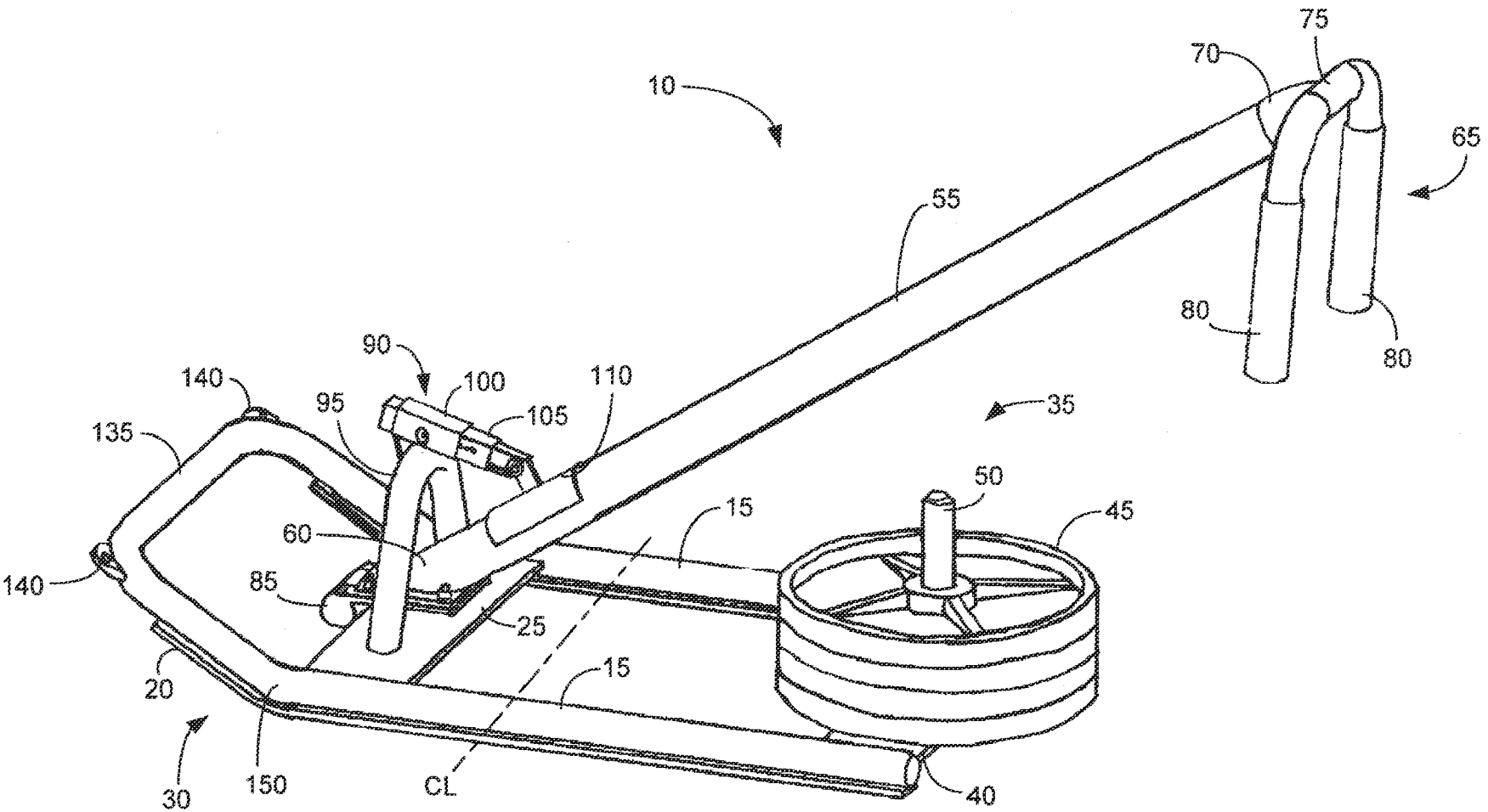
FIG. 1 is perspective view of a hip thrust sled according to one embodiment of the invention.
Figure 2:
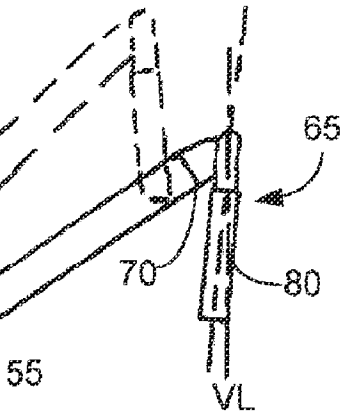
FIG. 2 is side view of the hip thrust sled of FIG. 1.
Figure 3:
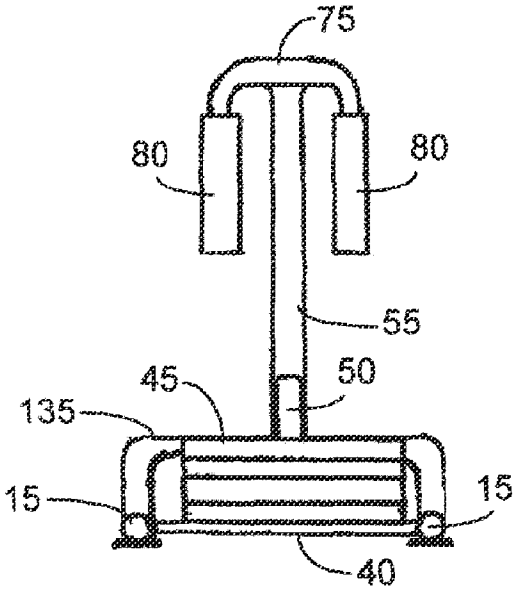
FIG. 3 is a front view of the hip thrust sled of FIG. 1.

As shown in FIGS. 1-3, a hip thrust sled 10 includes a pair of spaced apart runners 15 arranged generally parallel to each other to enable the hip thrust sled 10 to slide along the ground when force is applied to drive the hip thrust sled 10 forward. The spaced apart runners may be made of any suitable material, such as tubular aluminum or steel. The spaced apart runners 15 may also include flat skis 20 to help enable the spaced apart runners 15 to more easily slide along the ground. A first cross member 25 extends between and is connected to the pair of spaced apart runners 15 proximate to a distal end 30 of the hip thrust sled 10. The distal end 30 of the hip thrust sled 10 is the end furthest from the user during use, while a proximal end 35 is closest to the user during use. The first cross member 25 being proximate to the distal end 30 means that the first cross member 25 may be located at any point towards the distal end 30 of the hip thrust sled 10 beyond an imaginary center line CL of the hip thrust sled 10.

A second cross member 40 extends between and is connected to the pair of spaced apart runners 15 proximate to the proximal end 35 of the hip thrust sled 10. The second cross member 40 may be configured to hold removable weights 45. For example, the second cross member 40 may include a horn 50 that is configured to receive Olympic-style weight plates. The first cross member 25 and the second cross member 40 may be attached to the spaced apart runners 15 by any suitable means, such as by welding, mechanical fasteners (e.g., nuts and bolts), or chemical bonding.

A pendulum arm 55 is attached to the first cross member 25 at a distal end 60 of the pendulum arm 55. The pendulum arm 55 extends from the first cross member 25 towards the proximal end 35 of the hip thrust sled 10 at an angle A relative to the spaced apart runners 15. In a preferred exemplary embodiment, the pendulum arm 55 extends at an angle A of 45°, which encourages a user to flex his knees and roll his hips under his body as the pendulum arm 55 is lifted upwards, as described below.

A handlebar 65 may be attached to a proximal end 70 of the pendulum arm 55. The handlebar 65 may include a handlebar cross member 75 and two grips 80 extending downward from the cross member 75. The handlebar 65 may be angled inward relative to a vertical reference line VL. Further, the grips 80 of the handle bar 65 may be spaced approximately fifteen inches apart. This spacing may help to encourage what is known in football as "inside hands" or "tight hands." Specifically, this spacing will cause a user 145 to keep his hands closer together and train the user 145 to keep his elbows in when throwing a block.

The pendulum arm 55 may be connected to the first cross member 25 by a hinge 85. The hinge 85 enables the pendulum arm 55 to rotate relative to the first cross member 25, thereby enabling the proximal end 70 of the pendulum arm 55 and the handlebar 65 to move vertically relative to the spaced apart runners 15.

Figure 4:
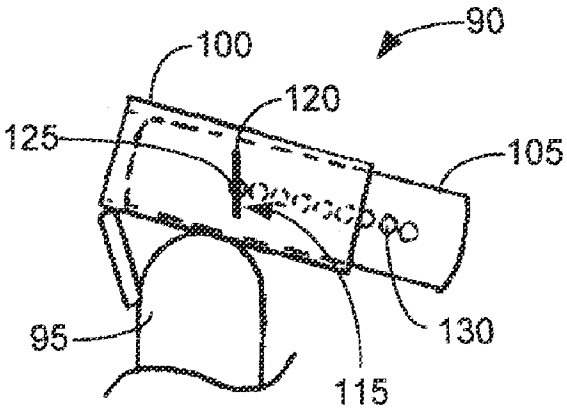
FIG. 4 is a side view of an adjustable stop according to one embodiment of the invention.

Referring also now to FIG. 4, an adjustable stop 90 may be attached to the first cross member 25 by a stop support member 95. The stop support member 95 may be a curvilinear member that straddles over the pendulum arm 55 such that the adjustable stop 90 may be attached above the pendulum arm 55. The adjustable stop 90 engages the pendulum arm 55 to limit the rotation of the pendulum arm 55, and thus limit the vertical movement of the proximal end 70 of the pendulum arm 55. The adjustable stop 90 may include an outer member 100 and a slide member 105 that is movable within the outer member 100. The slide member 105 may include a saddle 110 that is shaped to engage the pendulum arm 55. For example, if the pendulum arm 55 is a tubular member, the saddle 110 may be a mating half tube as shown. The saddle 110 may be movably connected to the slide member 105. When at rest, the proximal end 70 of the pendulum arm 55 will be at its lowest height. In use, when the pendulum arm 55 is pushed upward, the proximal end 70 of the pendulum arm 55 will move upwards until the pendulum arm 55 engages the saddle 110 on the adjustable stop 90, which is shown in broken lines in FIG. 2. Thus, the saddle 110 of the adjustable stop 90 limits the vertical movement of the pendulum arm 55.

The adjustable stop 90 may also include a locking member 115 to retain the slide member 105 in various positions within the outer member 100. For example, the locking member 115 may be a quick release pin that engages a hole 125 in the outer member 100 and one of a plurality of holes 130 within the slide member 105, thereby retaining the slide member 105 in a specific position within the outer member 100. This enables a user to adjust the adjustable stop 90 by removing the quick release pin 120, sliding the slide member 105 within the outer member 100 and replacing the quick release pin 120 through the hole 125 in the outer member and into one of the plurality of holes 130 in the slide member 105.

The hip thrust sled 10 may also include a distal end cross member 135 extending between the spaced apart runners 15 at the distal end 30 of the hip thrust sled 10. The distal end cross member 135 may curve upwards from the ground and be in a generally U-shaped configuration. The distal end cross member 135 may also include tow lugs 140 to which ropes or a harness may be attached to enable a user to pull the hip thrust sled 10.

Figure 5:
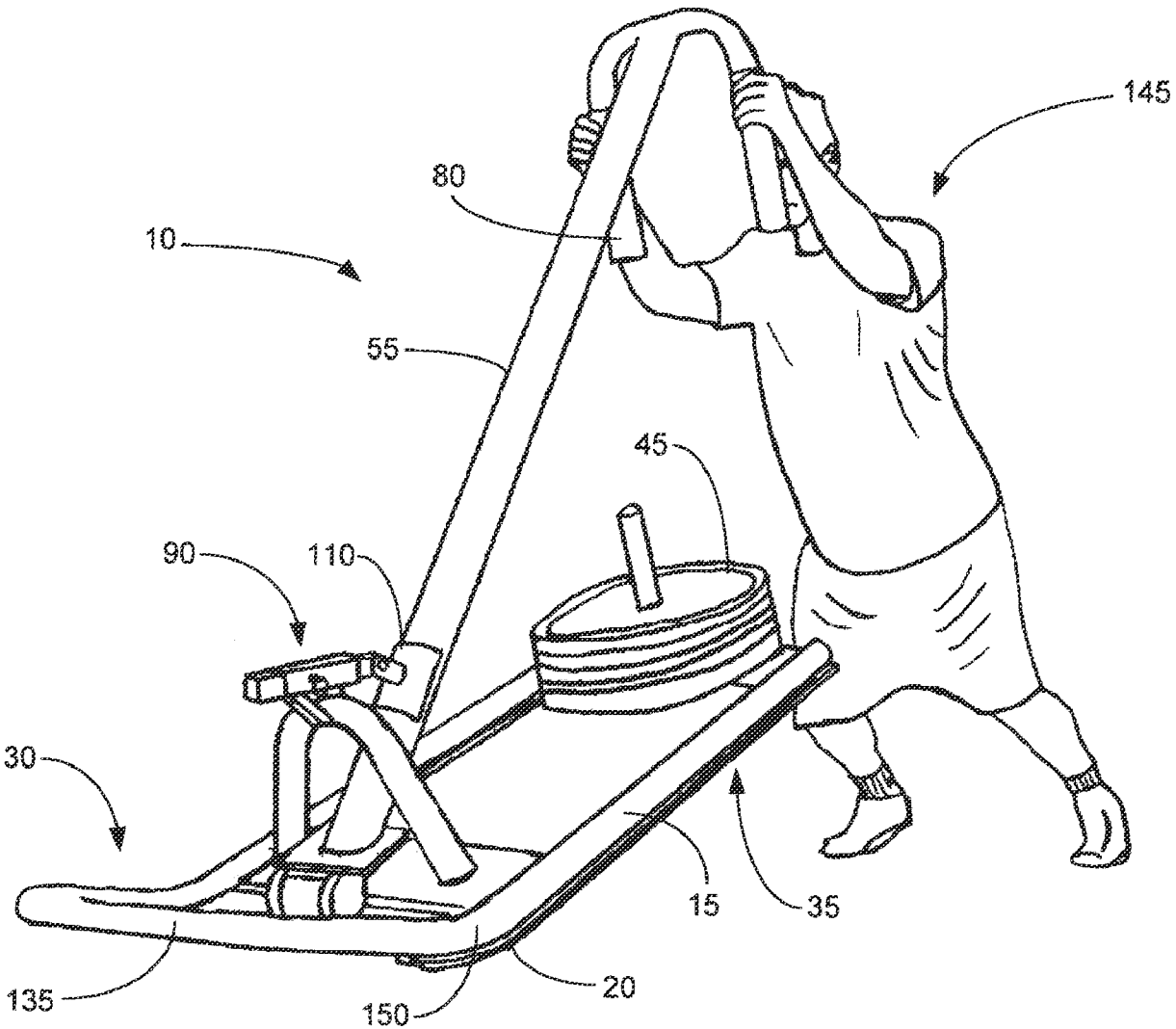
FIG. 5 is a perspective view of the hip thrust sled of FIG. 1 in use.

Referring also now to FIG. 5, to use the hip thrust sled 10, a user 145 first adjusts the adjustable stop 90. The adjustable stop 90 is adjusted to limit the maximum height to which the pendulum arm 55 may move vertically. This adjustment is set based on the height of the user 145. Once the user 145 has adjusted the maximum height, the user 145 holds the grips 80 in his hands and may start in any position from which he wants to train. For example, the user 145 may start in a flat back position. The user 145 then drives forward by pushing the hip thrust sled 10 in a horizontal position. The user 145 may then lift up on the grips 80 and thrust or roll his hips under his shoulders, which thereby lifts the pendulum arm 55 vertically until it engages the saddle 110 on the adjustable stop 90. Once the pendulum arm 55 engages the saddle 110 on the adjustable stop 90, further vertical movement by the user 145 will result in the proximal end 35 of the hip thrust sled 10, and thus the spaced apart runners 15, moving upwards out of contact with the ground. The spaced apart runners 15 bend upwards into the distal end cross member 135, which enables the user 145 to continue to both drive the hip thrust sled 10 forward while simultaneously lifting in a vertical direction. The hip thrust sled 10 will generally pivot around the intersection 150 of the spaced apart runners 15 and the distal end cross member 135. Further vertical movement of the proximal end 35 of the hip thrust sled 10 may cause the distal end cross member 135 to contact and stick into the ground thereby preventing further forward movement. The user 145 may then let go of the grips 80, which causes the proximal end 35 of the spaced apart runners 15 of the hip thrust sled 10 to return to contact with the ground and the pendulum arm 55 to return to its rest position. Alternatively, the user 145 may lower the pendulum arm 55, and thus the proximal end 35 of the spaced apart runners 15, until the hip thrust sled 10 may be driven forward again.

In another exemplary exercise, a user 145 may hold the grips 80 in his hand and explode forward thereby driving the hip thrust sled 10 forward as well as raising the proximal end 70 of the pendulum arm 55 upward. The user 145 may then quickly disengage from the grips 80, thereby releasing the hip thrust sled 10 and practicing an arm-over move whereby the user 145 moves his arm over the proximal end 70 of the pendulum arm 55 and moves quickly away from the hip thrust sled 10 at an angle. This exercise may enable a user 145 to practice locking out an opponent to then get to a quarterback.

The configuration of the hip thrust sled 10 as described with the removable weights 45 at the proximal end 35 of the hip thrust sled 10 closest to the user 145 and the pendulum arm 55 attaching to the hip thrust sled 10 at the distal end 30 of the hip thrust sled 10 better utilizes the removable weight 45 attached to the second cross member 40. Specifically, because the weight is distributed towards the proximal end 35 away from the fulcrum created by the hip thrust sled 10 at the intersection 150 of the runners 15 and the distal end cross member 135, the weight is more effectively used and the user 145 will experience more of the true weight attached to the sled 10. In other words, the hip thrust sled 10 will behave less as a lever which would provide mechanical advantage thereby diminishing the effective weight experienced by the user 145. This results in less weight having to be added to the hip thrust sled 10 than would be required if the hip thrust sled 10 acted as a lever.

It is to be understood that the foregoing description is intended to illustrate and not to limit the scope of the invention, which is defined by the scope of the appended claims. Other embodiments are within the scope of the following claims. For example, the pendulum arm 55 may be attached to the first cross member 25 without the use of a hinge 85. In such an alternative, exemplary embodiment, the distal end 60 of the pendulum arm 55 may be rigidly attached to the first cross member 25. This configuration will not enable the proximal end 70 of the pendulum arm 55 to move much in the vertical direction, other than potentially some vertical movement due to flexing of the pendulum arm 55 itself. Further, while specific exemplary configurations of the handlebar 65 have been disclosed, other configurations of the handlebar 65 are within the scope of the invention. Also, while the removable weights 45 have been described as Olympic-style weight plates removably attached to a horn 50, the removable weights 45 may be any type of weight removably retained on the hip thrust sled 10. For example, the removable weight 45 may be bags of sand held in a trough or box disposed proximate to the proximal end 35 of the hip thrust sled 10.

What is claimed is:

1. A hip thrust sled comprising:

a pair of spaced apart runners configured in parallel relation to each other, wherein the spaced apart runners include an upward bent portion at a distal end of the hip thrust sled;

a first cross member extending between and connected to the spaced apart runners between the upward bent portion and a center line of the hip thrust sled; and a pendulum arm attached at its distal end to the first cross member and extending towards a proximal end of the hip thrust sled at an upward angle relative to the spaced apart runners.

2. The hip thrust sled of claim 1 further comprising:

a second cross member extending between and connected to the spaced apart runners near a proximal end of the hip thrust sled and configured to receive removable weights.

3. A hip thrust sled comprising:

a pair of spaced apart runners configured in parallel relation to each other, wherein the spaced apart runners include an upward bent portion at a distal end of the hip thrust sled;

a first cross member extending between and connected to the spaced apart runners between the upward bent portion and a center line of the hip thrust sled; and a pendulum arm attached at its distal end to the first cross member and extending away from the first cross member at an upward angle relative to the spaced apart runners;

wherein the sled is configured to receive removable weights on a proximate side of the sled relative to the first cross member.

4. The sled of claim 3, where the pendulum arm extends towards a proximal end of the hip thrust sled.

5. The hip thrust sled of claim 3, further comprising:

a second cross member extending between and connected to the spaced apart runners near a proximal end of the hip thrust sled and configured to receive the removable weights.

* * * * *